US010499158B2

(12) United States Patent
Bushko

(10) Patent No.: US 10,499,158 B2
(45) Date of Patent: Dec. 3, 2019

(54) ELECTRO-ACOUSTIC TRANSDUCER WITH RADIATING ACOUSTIC SEAL AND STACKED MAGNETIC CIRCUIT ASSEMBLY

(71) Applicant: BOSE CORPORATION, Framingham, MA (US)

(72) Inventor: Darek Bushko, Hopkinton, MA (US)

(73) Assignee: BOSE CORPORATION, Framingham, MA (US)

( * ) Notice: Subject to any disclaimer, the term of this patent is extended or adjusted under 35 U.S.C. 154(b) by 65 days.

(21) Appl. No.: 14/716,126

(22) Filed: May 19, 2015

(65) Prior Publication Data

US 2016/0345100 A1 Nov. 24, 2016

(51) Int. Cl.
*H04R 9/02* (2006.01)

(52) U.S. Cl.
CPC ..... *H04R 9/025* (2013.01)

(58) Field of Classification Search
CPC ..... H04R 9/025
See application file for complete search history.

(56) References Cited

U.S. PATENT DOCUMENTS 2,069,242 A 2/1937 Graham
2,439,666 A 4/1948 Marquis
3,019,849 A 2/1962 King
3,651,283 A * 3/1972 Doschek ..... H04R 9/022 381/413
4,228,327 A 10/1980 Sawafuji
4,284,167 A 8/1981 Kozlow et al.
4,492,827 A * 1/1985 Shintaku ..... H04R 1/30 381/412
4,547,631 A 10/1985 Nieuwendijk et al.
5,317,552 A * 5/1994 Yamasaki ..... G11B 7/08582 359/814
6,714,655 B2 3/2004 Iwasa et al.
6,739,425 B1 5/2004 Griffin et al.
6,973,194 B2 12/2005 Iwasa et al.
7,006,654 B2 2/2006 Stiles et al.
7,477,757 B2 * 1/2009 Stiles ..... H04R 9/025 381/412
7,502,486 B2 3/2009 Shin et al.
8,335,339 B2 12/2012 Tagami et al.
2004/0120542 A1 * 6/2004 Morris, III ..... H04R 7/20 381/396
2004/0218778 A1 * 11/2004 Weisman ..... H04R 7/16 381/396

(Continued)

FOREIGN PATENT DOCUMENTS

JP H1155789 A 2/1999
JP 3893694 B2 3/2007

(Continued)

*Primary Examiner* — Matthew A Eason
*Assistant Examiner* — Taunya McCarthy
(74) *Attorney, Agent, or Firm* — Patterson + Sheridan, LLP

(57) ABSTRACT

An electro-acoustic transducer includes an accordion-type structure that functions as both an acoustic radiation element and an acoustic seal. In one example, the transducer includes parallel, accordion-type structures that attach to a flat, rectangular diaphragm. The diaphragm is connected to a voice coil. The voice coil and an associated frame are positioned between a magnet arrangement. The magnet arrangement includes stacked magnet pairs positioned between pole pieces to focus magnetic flux.

24 Claims, 9 Drawing Sheets

(56) References Cited

U.S. PATENT DOCUMENTS

| | | | | |
|---|---|---|---|---|
| 2005/0031154 | A1* | 2/2005 | Stiles | H04R 9/025 381/421 |
| 2007/0147651 | A1* | 6/2007 | Mitobe | H04R 9/025 381/396 |
| 2007/0297639 | A1 | 12/2007 | Noll | |
| 2010/0183171 | A1* | 7/2010 | Hsu Huang | H04R 7/20 381/150 |
| 2011/0158462 | A1* | 6/2011 | Horigome | H04R 9/043 381/413 |
| 2012/0051557 | A1 | 3/2012 | Horigome et al. | |
| 2015/0146910 | A1 | 5/2015 | Beer et al. | |
| 2016/0345099 | A1 | 11/2016 | Bushko et al. | |

FOREIGN PATENT DOCUMENTS

| | | | |
|---|---|---|---|
| JP | 3902066 | B2 | 4/2007 |
| JP | 4687400 | B2 | 5/2011 |

* cited by examiner

ELECTRO-ACOUSTIC TRANSDUCER WITH RADIATING ACOUSTIC SEAL AND STACKED MAGNETIC CIRCUIT ASSEMBLY

I. FIELD OF THE DISCLOSURE

The present disclosure relates generally to sound production assemblies, and more particularly, to electro-acoustic transducers.

II. BACKGROUND

The size of a loudspeaker conventionally affects its sound performance and application. Perceived sound quality (sound fullness) depends primarily on an electro-acoustic transducer's ability to reproduce low frequency tones. Unfortunately, reproduction of low frequency sound waves is associated with high power consumption. This problem is even more pronounced in small audio products that allow for only limited acoustic volume, thus increasing power demand due to the fact that the electro-acoustic transducer must work against high air pressure. Consequently, this creates a need for very compact and efficient electro-acoustic transducers.

III. SUMMARY

All examples and features mentioned below can be combined in any technically possible way.

In one implementation, an electro-acoustic transducer includes a first magnet pair that defines a first magnetic gap and a second magnet pair that defines a second magnetic gap. A first pole piece is positioned between the first and second magnetic pairs, and a voice coil positioned within the first and second magnetic gaps.

Examples may include one of the following features, or any combination thereof. The first and second magnetic gaps together may form a continuous magnetic gap.

A second pole piece may be positioned above the first magnetic pair, and a third pole piece may be positioned below the second magnetic pair.

A third magnet pair that defines a third magnetic gap may be included in the electro-acoustic transducer. The third magnetic pair may be positioned below the third pole piece.

A fourth pole piece may be positioned below the third magnet pair.

A third magnet pair that defines a third magnetic gap may be included in the electro-acoustic transducer. A fourth magnet pair that defines a fourth magnetic gap may additionally be included. The third magnet pair may be positioned adjacent the first magnet pair, and the fourth magnet pair may be positioned adjacent the second magnet pair.

The first and fourth magnetic gaps together may form a first continuous magnetic gap. The second and third magnetic gaps together may form a second continuous magnetic gap.

A substantially planar diaphragm may be connected to the voice coil.

Polarities of the first magnet pair may be opposite.

Polarities of the second magnet pair may be opposite.

The first pole piece may include a soft magnetic material.

The voice coil may be substantially planar.

In another example, an electro-acoustic transducer includes a first magnetic circuit comprising a first pole piece and a first magnet pair. The first magnetic circuit defines a first magnetic gap. A second magnet circuit includes the first pole piece and a second magnet pair. The second magnetic circuit defines a second magnetic gap.

Examples may include one of the following features, or any combination thereof. For instance, the first and second magnetic gaps together may form a continuous magnetic gap.

A substantially planar voice coil may be positioned within the first and second magnetic gaps.

A substantially flat diaphragm may be in communication with the voice coil.

A third magnetic circuit that defines a third magnetic gap may be included in the electro-acoustic transducer. The third magnetic circuit may include a second pole piece and a third magnet pair. The second pole piece may include part of the second magnetic circuit.

A fourth magnetic circuit that defines a fourth magnetic gap, wherein the fourth magnetic circuit comprises the second pole piece and a fourth magnet pair.

The first pole piece may include a soft magnetic material.

According to another example, an electro-acoustic transducer includes a first magnet pair that defines a first magnetic gap and a second magnet pair that defines a second magnetic gap. A first pole piece is positioned between the first and second magnet pairs. A second pole piece is positioned above the first magnet pair, and a third pole piece is positioned below the second magnet pair.

Examples may include one of the following features, or any combination thereof. The first and second magnetic gaps together may form a continuous magnetic gap.

A voice coil may be positioned within the first and second magnetic gaps.

A substantially rectangular diaphragm may be connected to the voice coil.

A third magnet pair may be positioned below the third pole piece.

A fourth pole piece may be positioned below the third magnet pair.

A third magnet pair may define a third magnetic gap, and a fourth magnet pair may define a fourth magnetic gap. The third magnet pair may be positioned adjacent the first magnet pair, and the fourth magnet pair may be positioned adjacent the second magnet pair.

The first and fourth magnetic gaps together may form a first continuous magnetic gap, and the second and third magnetic gaps together may form a second continuous magnetic gap.

An implementation of the electro-acoustic transducer described herein combines a sound radiating surface with an acoustic seal to produce sound, while resisting internal pressure and occupying less physical space. The electro-acoustic transducer includes an accordion-type suspension element that also functions as a sound radiation element and an acoustic seal. The accordion-type suspension element stabilizes the diaphragm during operation, and thus limits undesirable rocking. The electro-acoustic transducer's magnetic arrangement creates magnetic fields that are as much as 80% greater when compared to conventional electro-acoustic transducer designs. This generates proportionally stronger force per applied current resulting in dramatically higher efficiency of sound reproduction. These features are combined into a thin and narrow package, which enables the design of compact audio products. In addition, multiple electro-acoustic transducers may be arrayed to achieve greater sound output in a smaller package, leading to versatile loudspeaker configurations.

Other features, objects, and advantages will become apparent from the following detailed description and drawings.

IV. BRIEF DESCRIPTION OF THE DRAWINGS

V. DETAILED DESCRIPTION

Figure 1:
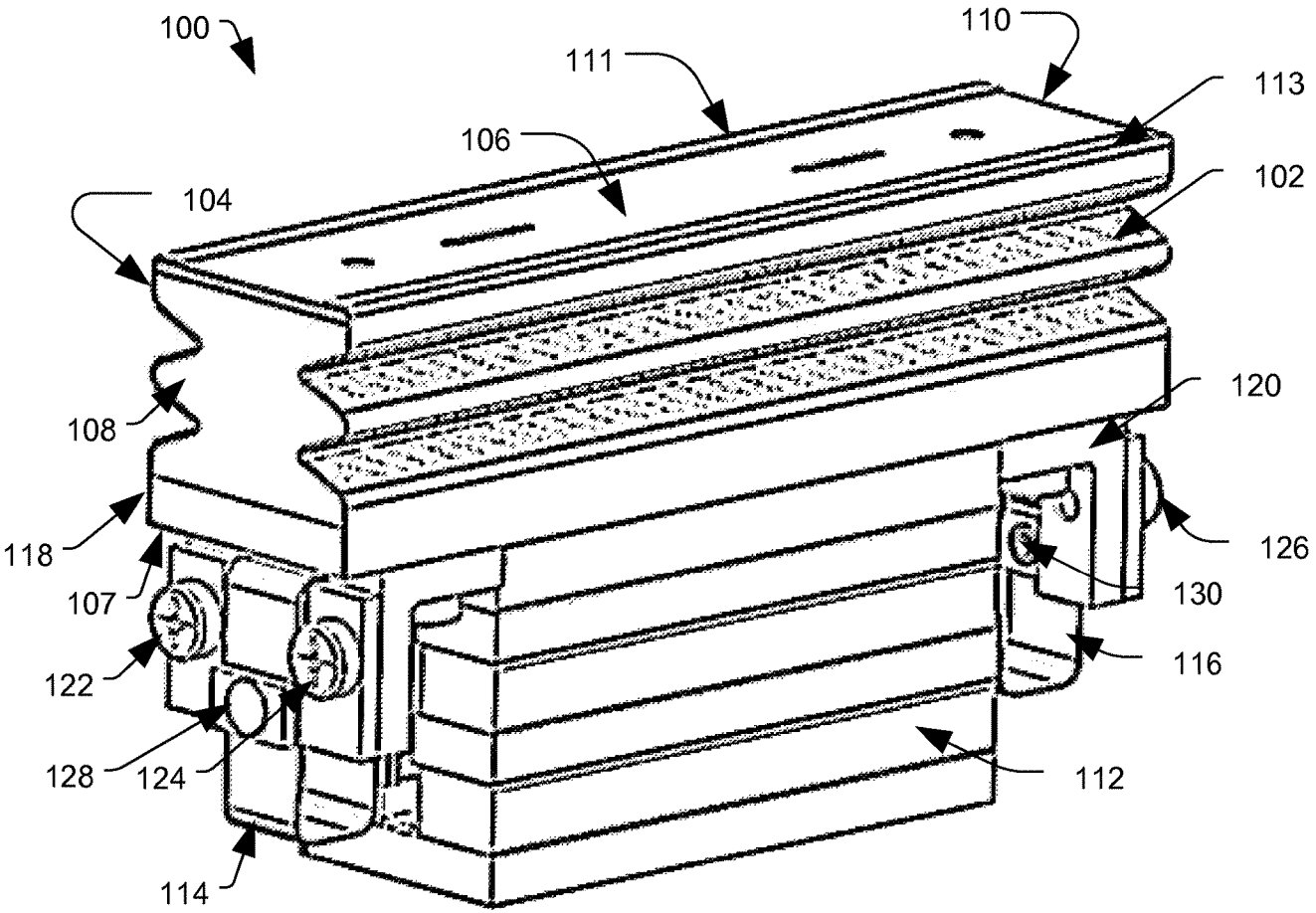
FIG. 1 illustrates a perspective view of an electro-acoustic transducer having accordion-type structures connected to a diaphragm.

An electro-acoustic transducer includes an accordion-type suspension structure that functions as both an acoustic radiation element and an acoustic seal. In one example, the electro-acoustic transducer includes parallel, accordion-type structures that attach to a flat, rectangular diaphragm (though other shapes may be used). The diaphragm is connected to a voice coil via a frame. The voice coil and associated frame are positioned between a magnet arrangement. The magnet arrangement includes stacked magnet pairs positioned between pole pieces to focus magnetic flux within a magnetic gap formed between the magnet pairs and pole pieces. The voice coil is positioned within the magnetic gap. When a current flows through the coil, the force generated by the magnetic arrangement and current flowing through the coil causes vibration in the coil, which, in turn, transfers force to the diaphragm and the accordion-type suspension elements through their contact with the diaphragm, resulting in the creation of sound.

The accordion-type structures may attach to opposing sides of the diaphragm. The accordion-type structures may have a varying number of bellow configurations, or folds. The number of bellow configurations, or folds, in the accordion surface is low enough to allow efficient sound generation.

The accordion-type structures may be sealed at the edges by a sound insulating material, such as foam, rubber, sponge, wood, steel, wool, fibers, carbon, plastic, and composites. The sound insulating material of one implementation may be arranged in a sound insulating structure, such as a honeycomb and other paneled configurations. In an example, the accordion-type structures are filled at least partially with a sound insulating material. For example, foam plugs may be positioned at ends of the accordion-type structures. The sound insulating material and accordion-type structures acoustically seal the diaphragm to the voice coil frame. The accordion-type structures additionally function as sound radiating surfaces, themselves. In some examples, at least half of the sound generated by the electro-acoustic transducer can be attributed to the accordion-type structures. Moreover, the accordion-type structures constrain movement of the diaphragm, thereby limiting undesirable rocking.

Illustrative configurations discussed herein include a double accordion configuration. Other implementations use a single accordion-type structure or more than two accordion structures. The number of bellow configurations or folds in the accordion-type structure(s) varies per acoustical specifications.

The stacked magnet configuration described herein increases the generated magnetic field by 60%-80% (e.g., between 1.6 Tesla and 1.8 Tesla) than that produced by a conventional magnetic circuit. In this manner, the magnetic configuration produces a higher force per current in a relatively small package when compared to convention electro-acoustic transducer designs. Pole spacers, or pole pieces, are added in between the magnets to provide a return path for the magnetic field, focusing the magnetic field on the area of the coil within the magnetic gap.

Figure 2:
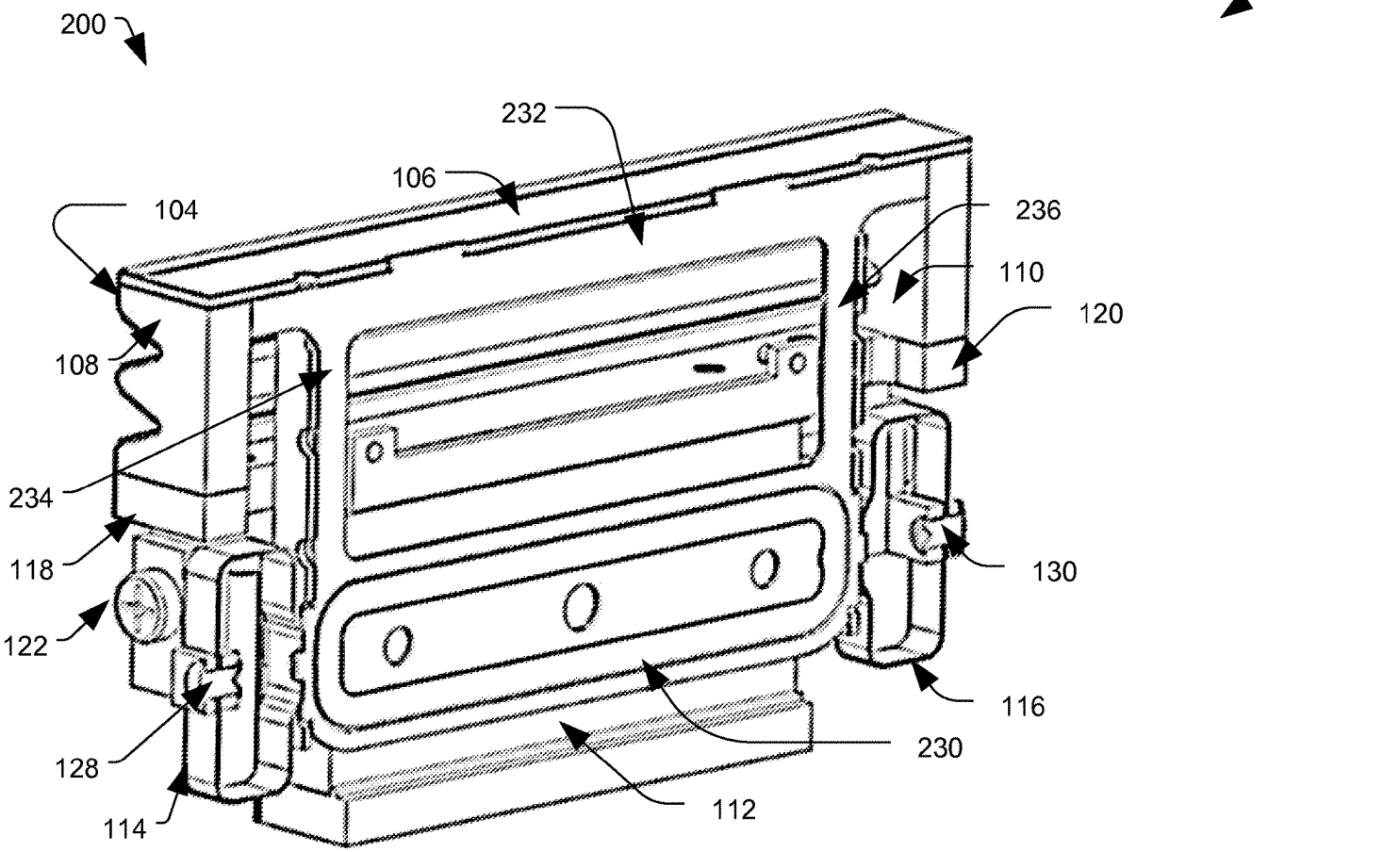
FIG. 2 depicts a cross-sectional perspective view of the electro-acoustic transducer of FIG. 1.

FIGS. 1 and 2 illustrate a perspective view and a cross-sectional perspective view of an electro-acoustic transducer 100. As shown, the electro-acoustic transducer 100 has accordion-type structures 102, 104 connected to a generally flat, rectangular diaphragm 106 (though other shapes may be used for the diaphragm, including a circle, oval, ellipse, racetrack or square). The diaphragm of some examples is constructed using plastic, wood, metal, fibrous, composites, or any suitable material. The accordion-type structures 102, 104 function as both acoustic radiation elements and acoustic seals. In other words, the accordion-type structures 102, 104 function to form an acoustic seal with the diaphragm 106 and support structure 107, and also output sound. The accordion-type structures 102, 104 vibrate to generate sound as forces are transferred to the accordion-type structures 102, 104 via the vibrating diaphragm 106. The accordion-type structures 102, 104 seal sound within a cavity formed by the accordion-type structures 102, 104, the diaphragm 106, and the support structure 107. The sound sealed within the cavity would otherwise escape and interfere with the sound generated by the diaphragm 106.

The accordion-type structures 102, 104 additionally constrain movement of the diaphragm 106 to limit rocking. The accordion-type structures 102, 104 provide support along the lengthwise edges 111, 113 of the diaphragm 106. The accordion-type structures 102, 104 transfer stabilizing forces from the support structure 107 to which the accordion-type structures 102, 104 are also attached. The accordion-type structures 102, 104 may be constructed of cloth, plastic, rubber, fibrous, metal, or any suitable material.

Sound insulating inserts, or plugs 108, 110 form an acoustic seal and provide structural support for the electro-acoustic transducer 100. The plugs 108, 110 may be constructed of foam, rubber, sponge, wood, steel, wool, fibers, carbon, plastic, and composites, or any other sound insulating material. The plugs 108, 110 may extend throughout the entire space enclosed by the diaphragm 106 and accordion-type structures 102, 104, or may only partially fill that space, as shown in FIGS. 1 and 2. The accordion-type structures 102, 104 along with the diaphragm 106 and sound insulating plugs 108, 110 form at least a partial cavity, and may seal sound propagating upward from below stator structures 118, 120. The stator structures 118, 120 of an example include stationary structures constructed from plastic, rubber, metal, or composite materials.

As shown in FIG. 1, the accordion-type structures 102, 104 include accordion folds, or pleats. The accordion pleats are formed by adjacent surfaces that may form an acute angle relative to one another when the electro-acoustic transducer 100 is at rest. Although two folds or pleats are shown in FIG. 1, other numbers of folds are used in other implementations. The number of bellow configurations, or folds, in the accordion surface is set low enough to allow efficient sound generation. For example, the number of folds is set according to the sound generation characteristics and the stability provided by the accordion-type structures 102, 104 of the accordion configuration, as determined by empirical data.

As is shown in FIG. 2, the diaphragm 106 is connected to a voice coil 230 and an associated frame 232 that is positioned inside of a magnetic gap formed by a magnet arrangement 112. When a current is applied to the voice coil 230, force generated by the voice coil 230 is transferred to the diaphragm 106 via posts 234, 236 of the frame 232 to produce sound. The posts 234, 236 additionally function to suspend the diaphragm 106. The voice coil 230 is generally planar and racetrack shaped, however, other shapes are used in other examples. The frame 232 is also generally planar, as shown in FIG. 2.

Flexures 114, 116 are attached to the stator structures 118, 120 and the voice coil via fasteners 122, 124, 126, 128, 130. The flexures 114, 116 permit limited motion between the voice coil 230, the frame 232 and the stator structures 118, 120. In addition to providing flex to the electro-acoustic transducer 100 to absorb structural vibrations, the flexures 114, 116 serve as lead outs to couple an input signal (current) from an external power source to the voice coil.

Figure 3:
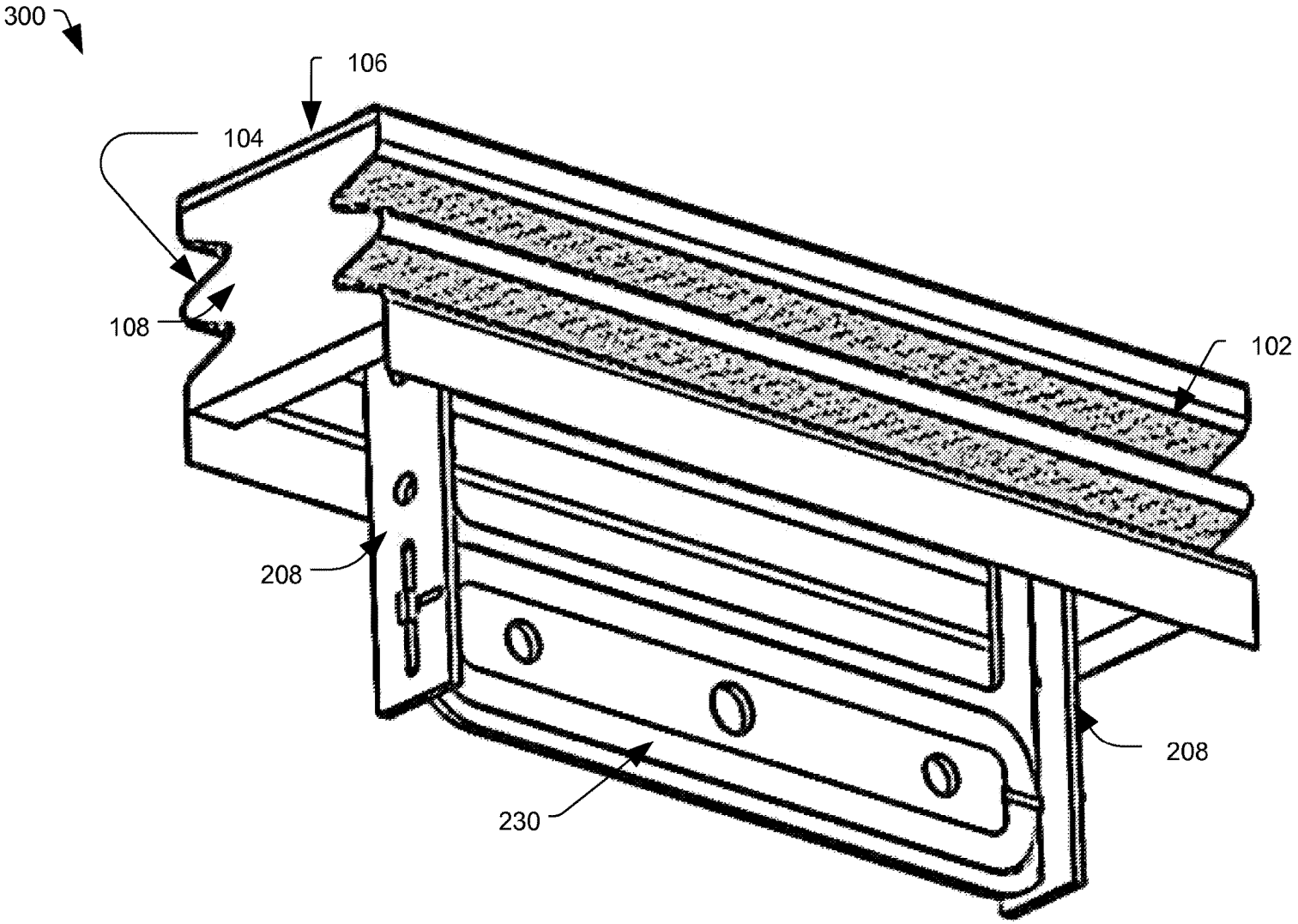
FIG. 3 illustrates a perspective view of an upper portion of the electro-acoustic transducer of FIG. 1.

FIG. 3 illustrates a perspective view of an upper portion 300 of the electro-acoustic transducer of FIG. 1. More particularly, FIG. 3 shows the accordion-type structures 102, 104 and the voice coil 230 connected to the diaphragm 106. As described herein, the accordion-type structures 102, 104 function as both acoustic radiation elements and acoustic seals.

Figure 4:
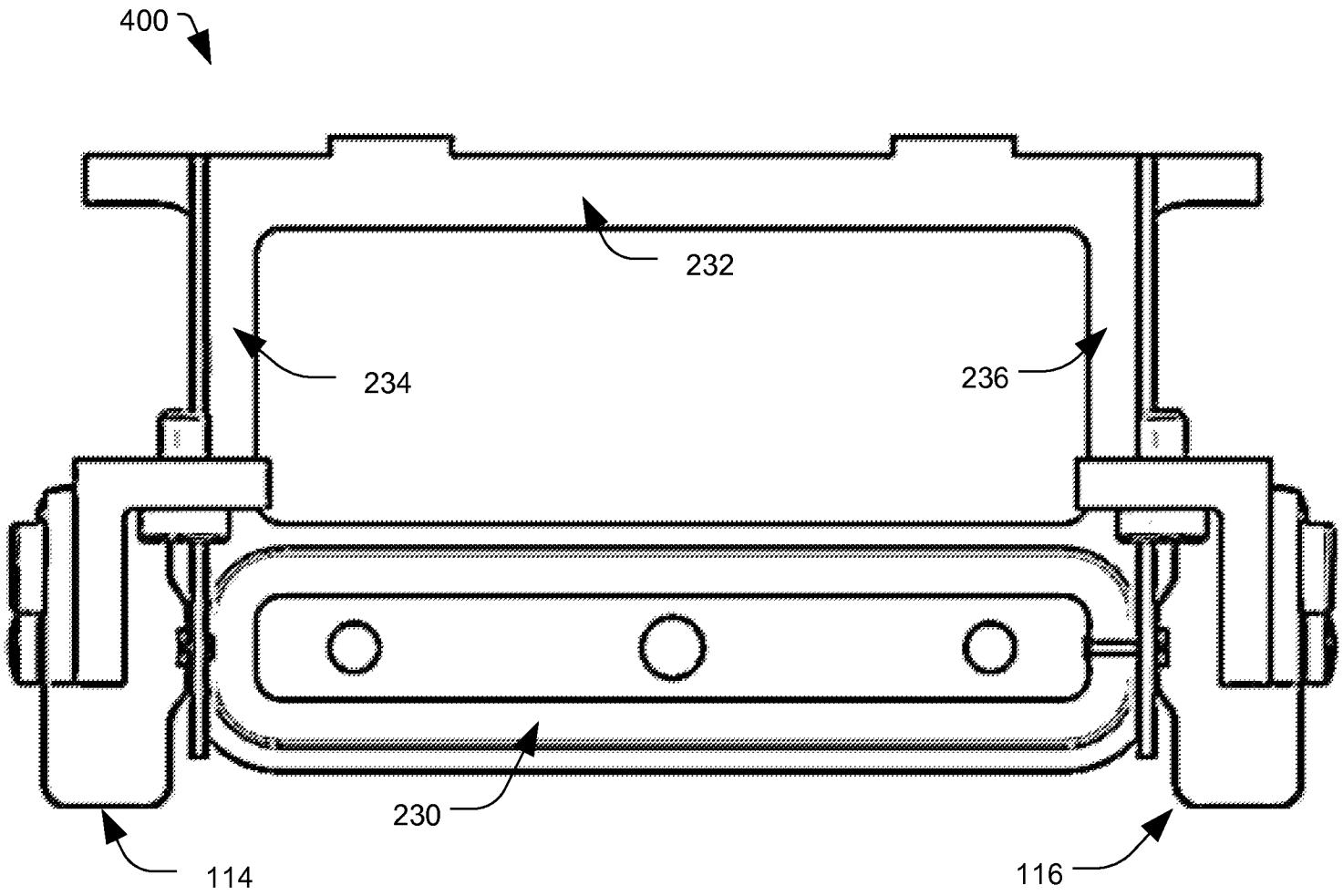
FIG. 4 shows a side view of an assembly that includes the voice coil and the frame of FIG. 1.

FIG. 4 shows a side view of an assembly 400 that includes the voice coil 230 and the frame 232 of FIG. 1. As illustrated, flexures 114, 116 are secured to the frame 232 and voice coil 230. The flexures 114, 116 absorb vibrations and also function as lead-outs, as described herein. In this manner, the dual role of the flexures 114, 116 reduces space requirements. Posts 234, 236 couple the voice coil 230 to a portion of the frame 232 that contacts the diaphragm.

Figure 5:
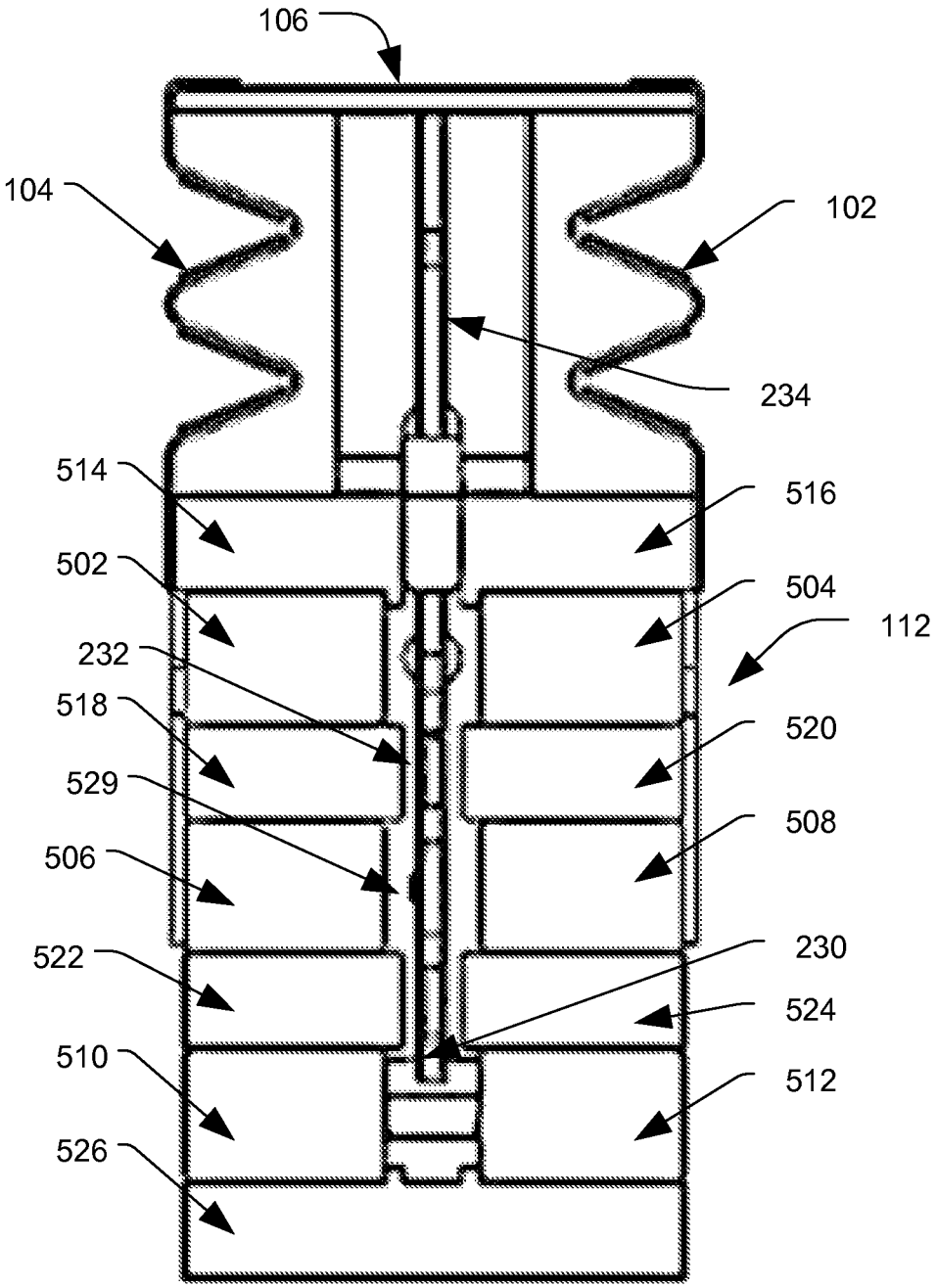
FIG. 5 illustrates a cross-sectional end view of the electro-acoustic transducer showing a magnet assembly, and the voice coil coupled to a frame.

FIG. 5 illustrates a cross-sectional end view of the electro-acoustic transducer 100 of FIG. 1. The electro-acoustic transducer 100 includes a voice coil 230 that is coupled to a frame 232. The frame 232 transfers vibrational energy to the diaphragm 106. The accordion-type structures 102, 104 are attached to sides of the diaphragm 106 and to a magnet assembly 112.

The configuration depicted in FIGS. 1-5 includes a double accordion configuration in that there are two accordion-type structures, each positioned on an end of the diaphragm 106. However, any number of accordion-type structures may be used. For example, another implementation may use a single accordion structure or more than two accordion structures. In addition, the number of folds, pleats, or bellows in each accordion structure may very per acoustical specifications. For instance, empirical data may be used to determine which desired sound characteristics (e.g., amplitude, propagation factors, intensity, tonal quality, among others) are produced for designs having different numbers of folds, pleats, or bellows.

As shown in FIG. 5, the magnet assembly 112 includes magnets 502, 504, 506, 508, 510, 512 and pole pieces 514, 516, 518, 520, 522, 524, 526. The magnets and pole pieces are stacked in a generally vertical configuration, positioned in a 2×3 matrix of 2 columns and 3 rows, so the magnets and pole pieces form a physical and magnetic gap 529 between the 2 columns. The voice coil 230 is positioned in the gap. The magnets 502, 504, 506, 508, 510, 512 are positioned in between the pole pieces 514, 516, 518, 520, 522, 524, 526 in an alternating manner to provide a return path for a magnetic field, thereby focusing the magnetic field generated by the magnets on the area of the voice coil 230. This configuration generates a magnetic field that is 60%-80% stronger (e.g., between 1.6 Tesla and 1.8 Tesla) than that produced by a conventional magnetic circuit.

The pole pieces 514, 516, 518, 520, 522, 524, 526 and the magnets 502, 504, 506, 508, 510, 512 comprise part of a stator portion of the electro-acoustic transducer 100. While the magnets 502, 504, 506, 508, 510, 512 and pole pieces 514, 516, 518, 520, 522, 524, 526 are shown as being generally rectangular in shape, other shapes may be used. The magnets may be constructed of ferromagnetic metals, such as nickel and iron, or may be electromagnetic. The pole pieces may be constructed of a soft magnetic material, such as low carbon steel, iron, and cobalt. While six magnets are shown in FIG. 5, other implementations may operate with fewer (e.g., four magnets) or with additional pairs of magnets exceeding over six total magnets.

As discussed herein, the vertical configuration of the magnets 502, 504, 506, 508, 510, 512 and pole pieces 514, 516, 518, 520, 522, 524, 526 provides sufficient magnetic field to the voice coil 230 so as to vibrate the diaphragm 106 and accordion structure 102. More particularly, the magnets 502, 504, 506, 508, 510, 512 and pole pieces 514, 516, 518, 520, 522, 524, 526 are arranged in alternating manner to generate and redirect magnetic fields (e.g., via return paths shown in subsequent FIG. 7) towards the area of the voice coil 230.

In operation, when electrical current flowing through the voice coil 230 changes direction, the polar orientation of the voice coil 230 reverses. This reversal changes the magnetic forces between the voice coil 230 and the magnets 502, 504, 506, 508, 510, 512, moving the voice coil 230 and attached diaphragm 106 back and forth. Alternating current constantly reverses the magnetic forces between the voice coil 230 and the magnets 502, 504, 506, 508, 510, 512. This pushes the voice coil 230 back and forth. As the voice coil 230 moves, it pushes and pulls on the diaphragm 106. The movement of the diaphragm vibrates the air in front of the diaphragm 106 and the accordion-type structures to create sound waves.

Figure 6:
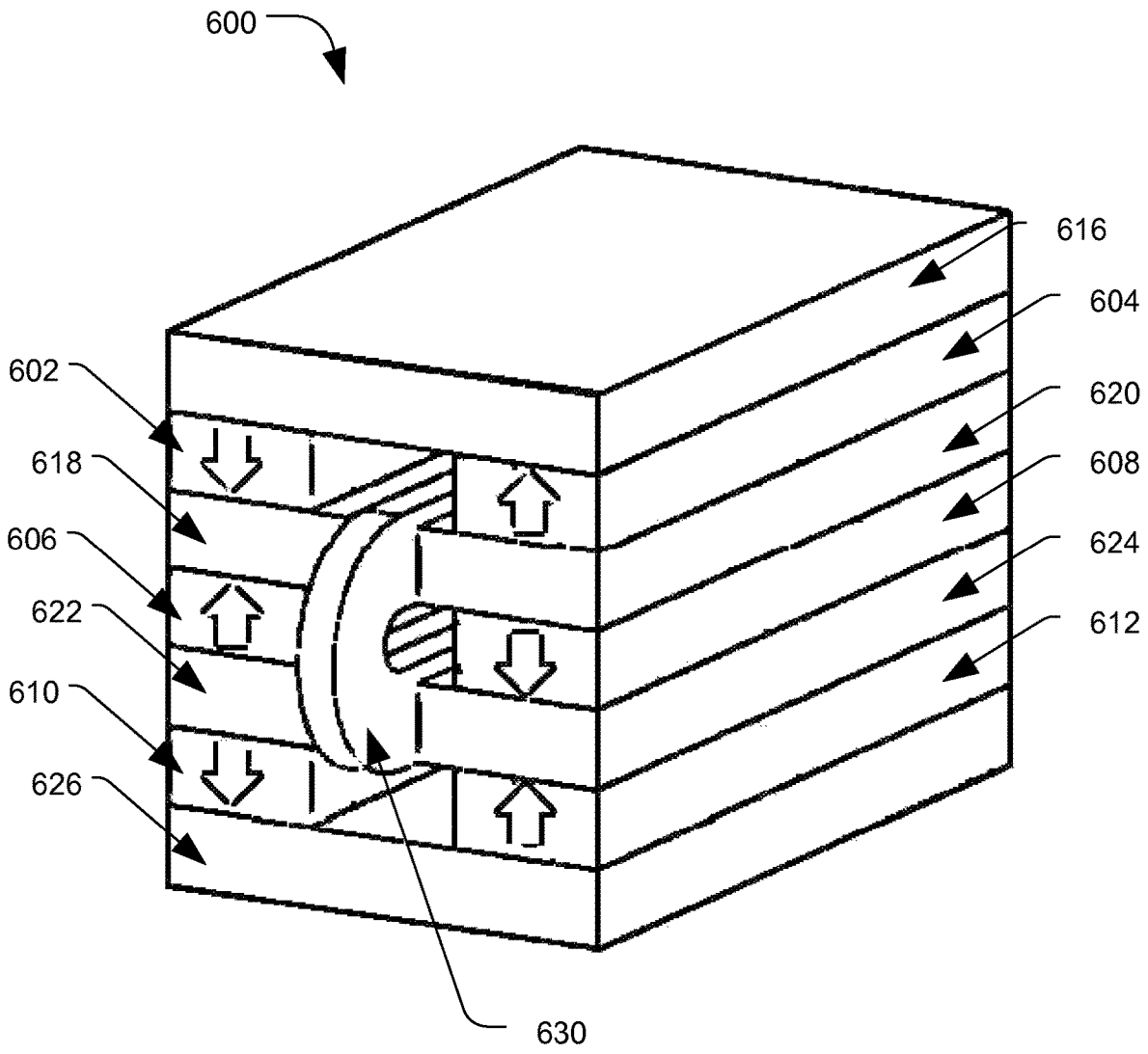
FIG. 6 illustrates a magnet assembly that is similar to the magnet assembly shown in FIG. 5.

FIG. 6 illustrates a perspective view of a magnet assembly 600 that is similar to the magnet assembly 112 shown in FIG. 5. The magnet assembly 600 includes a physical and magnetic gap into which a voice coil 630 is positioned. The magnet assembly 600 further includes magnets 602, 604, 606, 608, 610, 612 and pole pieces 616, 618, 620, 622, 624, 626 positioned in an alternating manner and stacked in a generally vertical configuration, as in FIG. 5. The arrows depicted on the magnets 602, 604, 606, 608, 610, 612 show their magnetic orientation. As shown in FIG. 6, the polarities of the magnets in each magnetic pair 602 and 604, 606 and 608, 610 and 612 are opposite one another. Thus, when viewing each magnet pair in a horizontal plane, each magnet in the pair has an opposite polarity. Moreover, the polarities of each vertically subsequent magnet 602, 604, 606, 608, 610, 612 are opposite. For example, in the left-most vertical stack of magnets in FIG. 6, magnet 602 has an opposite polarity to magnet 604 and magnet 606; magnet 606 has an opposite polarity to magnet 608, magnet 602 and magnet 610; and magnet 610 has an opposite polarity to magnet 612 and magnet 606. Similarly, in the right-most vertical stack of magnets in FIG. 6, magnet 604 has an opposite polarity to magnet 602 and magnet 608; magnet 608 has an opposite polarity to magnet 606, magnet 604 and magnet 612; and magnet 612 has an opposite polarity to magnet 610 and magnet 608. The orientations of the polarities of the magnets 602, 604, 606, 608, 610, 612 determine the direction and magnitude of the magnetic fields, as discussed further herein.

The pole pieces 616, 618, 620, 622, 624, 626 are positioned in between the magnets 602, 604, 606, 608, 610, 612. As in the example shown in FIG. 5, the pole pieces 616, 618, 620, 622, 624, 626 may be constructed of a soft magnetic material, such as low carbon steel, iron, or cobalt, and the magnets may be constructed of ferromagnetic metals, such as nickel and iron, or may be electromagnetic. The pole pieces 616, 618, 620, 622, 624, 626 provide a return path for a magnetic field, thereby focusing the magnetic field generated by the magnets on the area of the voice coil 630. This configuration generates a magnetic field that is 60%-80% stronger (e.g., between 1.6 Tesla and 1.8 Tesla) than is generated by a conventional magnetic circuit.

Figure 7:
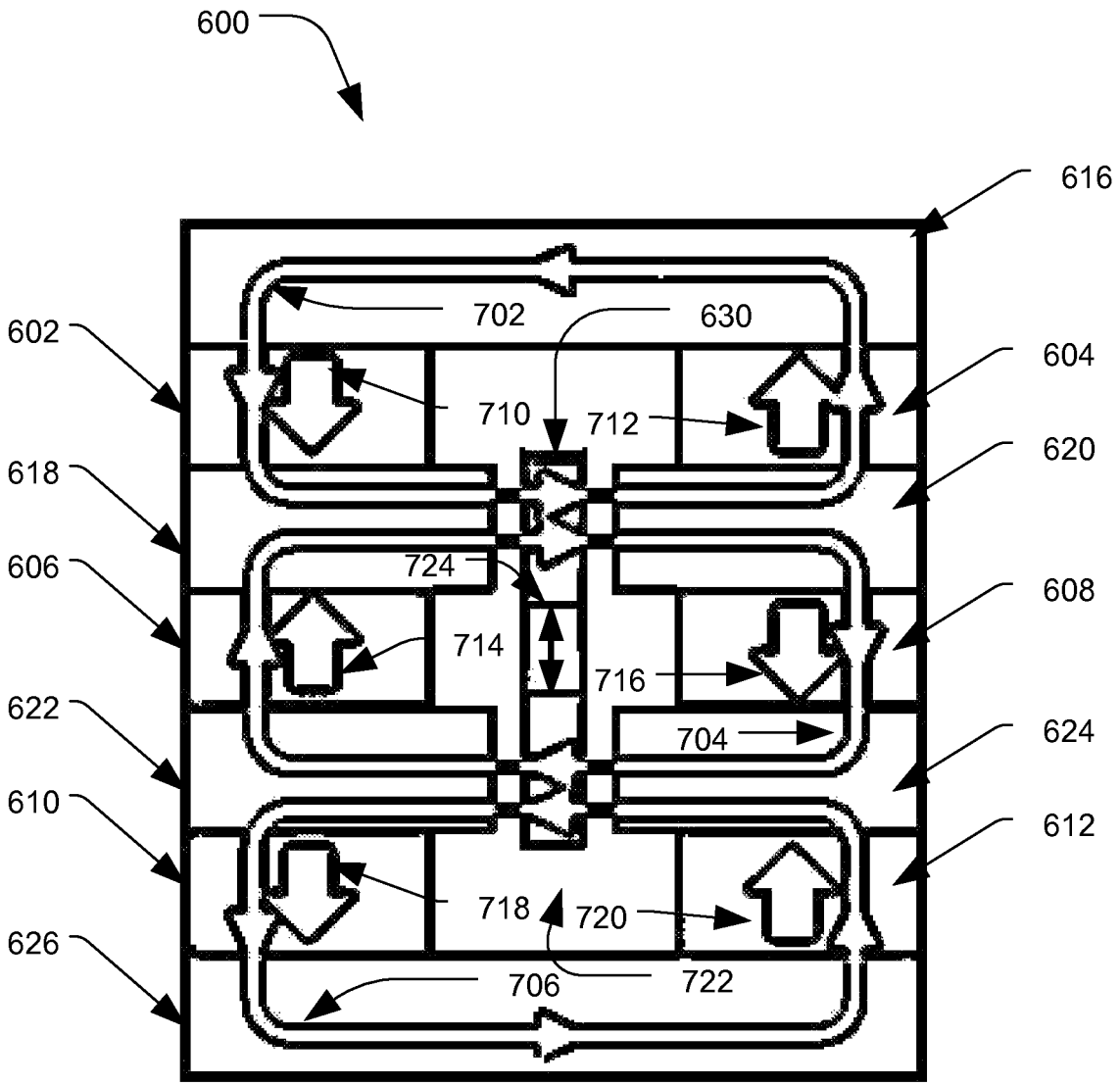
FIG. 7 is an end view of the magnet assembly FIG. 7, also showing magnetic fields and polarizations.

FIG. 7 is an end view of the magnet assembly 600 of FIG. 6. The view includes magnetic fields 702, 704, 706 generated by the magnet assembly 600, in addition to the polarizations 710, 712, 714, 716, 718, 720 of the magnets 602, 604, 606, 608, 610, 612. Multiple magnetic circuits (i.e., each comprising a magnetic pair: 602 and 604, 606 and 608, 610 and 612) focus the magnetic fields 702, 704, 706 into the air gap 722 where the moving voice coil 630 is located. More specifically, three magnetic circuits (i.e., each comprising a magnetic pair 602 and 604, 606 and 608, 610 and 612) generate magnetic fields in the magnetic gap. An arrow 724 designates the relative direction of the reciprocal movement of the voice coil 630. As discussed herein, force from the movement of the voice coil 630 is transferred by frame posts (not shown) to a diaphragm (not shown) to generate sound.

Figure 8:
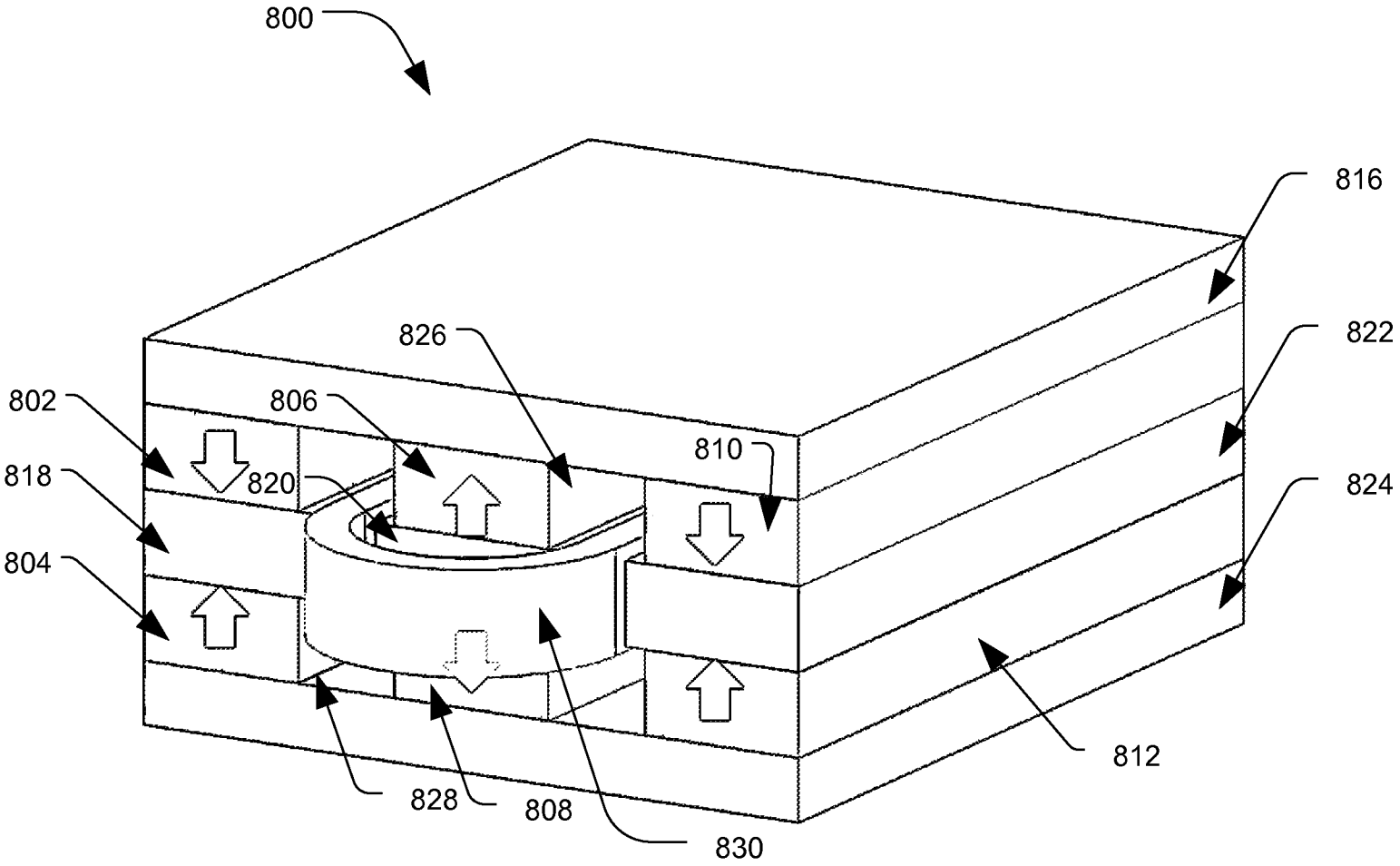
FIG. 8 illustrates a perspective view of another magnet assembly for use with diaphragm and accordion-type structures.

FIG. 8 illustrates a perspective view of another magnet assembly 800 that is used with diaphragm and accordion-type structures, such as those described herein. In this configuration, magnets 802, 804, 806, 808, 810, 812 and pole pieces 816, 818, 820, 822, 824 are stacked in a 3×2 matrix of 3 columns and 2 rows, so the magnets and pole pieces form multiple physical and magnetic gaps 826, 828 in between each pair of columns. A voice coil 830 is positioned in the gaps 826, 828. Magnets 802, 804, 806, 808, 810, 812 are positioned in between the pole pieces 816, 818, 820, 822, 824 in an alternating manner to provide a return path for a magnetic field, thereby focusing the magnetic field generated by the magnets on the area of the voice coil 830. As in FIGS. 6 and 7, the arrows depicted on the magnets 802, 804, 806, 808, 810, 812 show their magnetic orientation. By providing the return paths back to the voice coil 830, the configuration of FIG. 8 generates a comparable magnetic field to the configuration shown in FIGS. 6 and 7. The magnetic field is sufficiently strong to communicate a desired amount of vibrational energy within the voice coil 830 so as to generate quality sound using diaphragm and accordion-type structures, such as those described herein.

Figure 9:
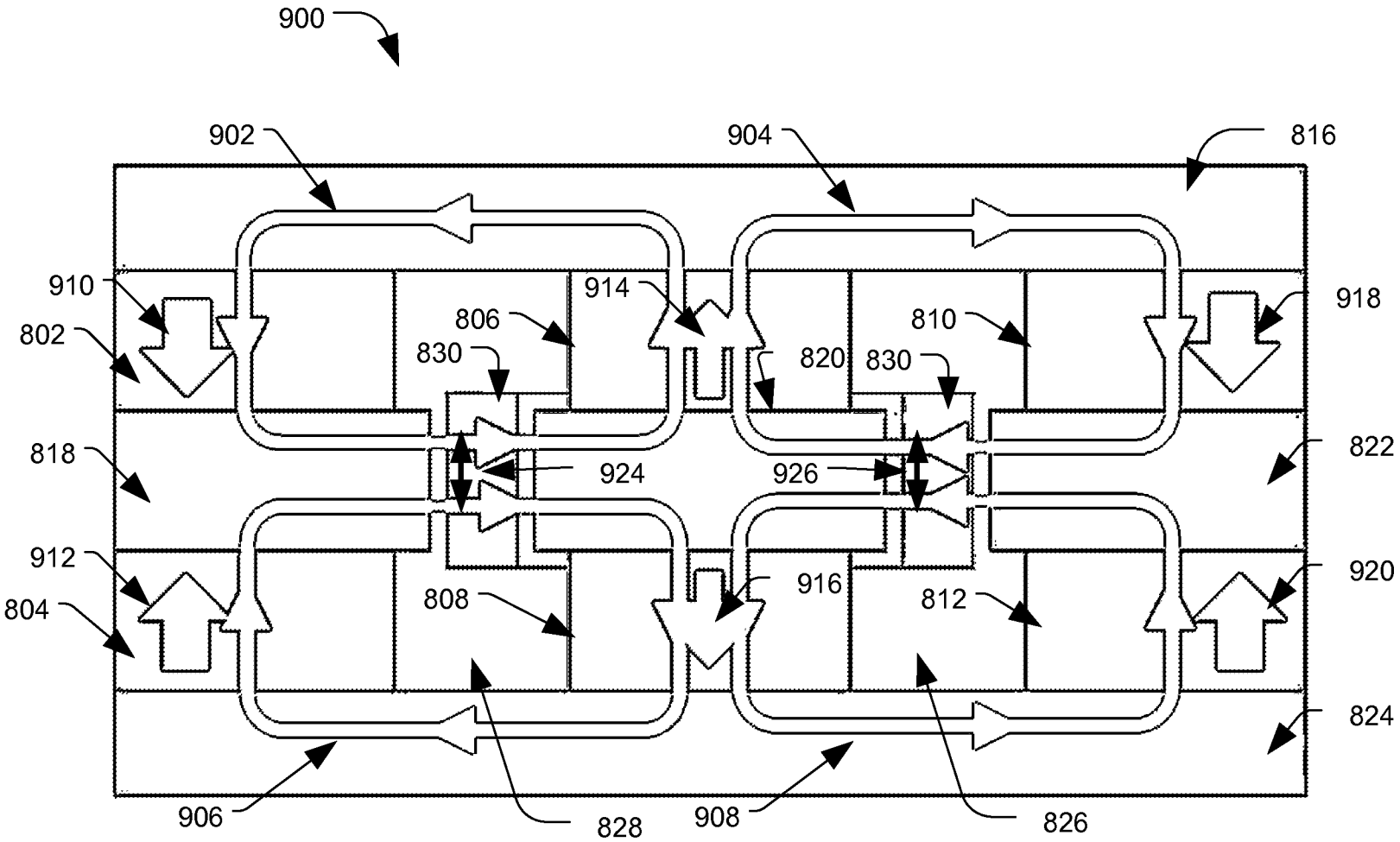
FIG. 9 is an end view of the magnet assembly of FIG. 8, also showing magnetic fields and polarizations.

FIG. 9 is an end view of the magnet assembly 800 of FIG. 8. The view includes magnetic fields 902, 904, 906, 908 generated by the magnet assembly 800. The view additionally shows the polarizations 910, 912, 914, 916, 918, 920 of the magnets 802, 804, 806, 808, 810, 812. Multiple magnetic circuits (i.e., each comprising a magnetic pair: 802 and 806, 806 and 810, 804 and 808, 808 and 812) focus the magnetic fields 902, 904, 906, 908 into the air gaps 826, 828 where the moving voice coil 830 is located. More specifically, four magnetic circuits (i.e., each comprising a magnetic pair 802 and 806, 806 and 810, 804 and 808, 808 and 812) generate magnetic fields in the magnetic gap. Arrows 924, 926 designate the relative direction of the reciprocal movement of the voice coil 830. As discussed herein, force from the moving voice coil 830 is transferred by frame posts (not shown) to a diaphragm (not shown) to generate sound.

A number of implementations have been described. Nevertheless, it will be understood that additional modifications may be made without departing from the scope of the inventive concepts described herein, and, accordingly, other embodiments are within the scope of the following claims.

What is claimed is:

1. An electro-acoustic transducer comprising:

a first magnet pair that forms a first magnetic gap therebetween;

a second magnet pair that forms a second magnetic gap therebetween, wherein the second magnetic gap is aligned with the first magnetic gap;

a first pole piece disposed adjacent to a second pole piece, the first pole piece and the second pole piece being disposed between the first magnet pair and the second magnet pair;

a third pole piece disposed below the second magnet pair, wherein the third pole piece has a length that spans the second magnetic gap;

a voice coil having a portion positioned within the first magnetic gap and the second magnetic gap;

a diaphragm spaced from the voice coil;

a frame connecting the diaphragm to the voice coil;

a flexure connected to the frame and to the voice coil, wherein the flexure is configured to absorb vibrations and to serve as a conductive lead out to couple current from an external power source to the voice coil; and a foldable membrane coupled to an edge of the diaphragm and disposed between the diaphragm and the first magnet pair, wherein the foldable membrane includes a fold formed by two adjacent surfaces of the membrane forming an acute angle when the electro-acoustic transducer is at rest.

2. The electro-acoustic transducer of claim 1, further comprising a fourth pole piece and a fifth pole piece disposed adjacent to the fourth pole piece, the fourth pole piece and the fifth pole piece being disposed between the first magnet pair and the second magnet pair.

3. The electro-acoustic transducer of claim 2, further comprising a third magnet pair that defines a third magnetic gap.

4. The electro-acoustic transducer of claim 1, wherein the first magnet pair comprises a first magnet and a second magnet, and the second magnet pair comprises a third magnet and a fourth magnet, wherein a third magnet pair that forms a third magnetic gap and is aligned with the first magnet pair, the third magnet pair comprising the second magnet and a fifth magnet;

wherein a fourth magnet pair that forms a fourth magnetic gap and is aligned with the second magnet pair, the fourth magnet pair comprising the fourth magnet and a sixth magnet;

wherein a fourth pole piece is disposed adjacent to the second pole piece, the fourth pole piece being disposed between the fifth magnet and the sixth magnet;

wherein a fifth pole piece is disposed above the first magnet pair and the third magnet pair, wherein the fifth pole piece has a length that spans the first magnet gap and the third magnet gap; and wherein the third pole piece has a length that spans the second magnetic gap and the fourth magnetic gap.

5. The electro-acoustic transducer of claim 1, wherein the diaphragm is substantially planar.

6. An electro-acoustic transducer comprising:

a first magnetic circuit comprising a first pole piece disposed adjacent to a second pole piece, the first pole piece and the second pole piece being disposed below a first magnet pair, wherein the first magnetic circuit forms a first magnetic gap;

a second magnet circuit comprising the first pole piece disposed adjacent to the second pole piece and a second magnet pair disposed below the first pole piece and the second pole piece, wherein the second magnetic circuit forms a second magnetic gap;

a third pole piece disposed below the second magnet pair having a length that spans the second magnetic gap;

a voice coil;

a diaphragm spaced from the voice coil;

a frame connecting the diaphragm to the voice coil;

a flexure connected to the frame and to the voice coil, wherein the flexure is configured to absorb vibrations and to serve as a conductive lead out to couple current from an external power source to the voice coil; and a foldable membrane coupled to an edge of the diaphragm and disposed between the diaphragm and the first magnet pair, wherein the foldable membrane includes a fold formed by two adjacent surfaces of the membrane forming an acute angle when the electro-acoustic transducer is at rest.

7. The electro-acoustic transducer of claim 6, wherein the first magnetic gap and the second magnetic gap together form a continuous magnetic gap, and wherein the diaphragm and a support structure form a sound-sealed cavity.

8. The electro-acoustic transducer of claim 6, wherein the voice coil is substantially planar and positioned within the first and second magnetic gaps.

9. The electro-acoustic transducer of claim 8, wherein the diaphragm is substantially flat and in communication with the voice coil.

10. The electro-acoustic transducer of claim 6, further comprising a third magnetic circuit that forms a third magnetic gap.

11. The electro-acoustic transducer of claim 10, further comprising a fourth magnetic circuit that forms a fourth magnetic gap.

12. An electro-acoustic transducer comprising:

a first magnet pair that forms a first magnetic gap;

a second magnet pair that forms a second magnetic gap;

a first pole piece disposed adjacent to a second pole piece, the first pole piece and the second pole piece being disposed between the first and second magnet pairs;

a third pole piece disposed below the second magnet pair and having a length that spans the second magnetic gap;

a voice coil having a portion positioned within the first magnetic gap or the second magnetic gap, and wherein the voice coil is positioned in at least the first magnetic gap or the second magnetic gap;

a diaphragm spaced from the voice coil;

a frame directly connecting the diaphragm to the voice coil;

a flexure connected to the frame and to the voice coil, wherein the flexure is configured to absorb vibrations and to serve as a conductive lead out to couple current from an external power source to the voice coil; and an accordion structure coupled to an edge of the diaphragm and disposed between the diaphragm and the first magnet pair, wherein the accordion structure includes a fold formed by two adjacent surfaces of the accordion structure forming an acute angle when the electro-acoustic transducer is at rest.

13. The electro-acoustic transducer of claim 12, wherein the first magnetic gap and the second magnetic gap together form a continuous magnetic gap.

14. The electro-acoustic transducer of claim 12, further comprising a third magnet pair disposed above the first pole piece and the second pole piece.

15. The electro-acoustic transducer of claim 12, further comprising a third magnet pair that defines a third magnetic gap, and a fourth magnet pair that defines a fourth magnetic gap, and wherein the third magnet pair is positioned adjacent the first magnet pair, and the fourth magnet pair is positioned adjacent the second magnet pair.

16. The electro-acoustic transducer of claim 12, further comprising a second flexure mounted in parallel with a plane of the frame.

17. The electro-acoustic transducer of claim 1, wherein the flexure is further configured to allow limited motion between the voice coil and the frame.

18. The electro-acoustic transducer of claim 1, further comprising a second flexure.

19. The electro-acoustic transducer of claim 1, wherein the flexure is mounted in parallel with a plane of the frame.

20. The electro-acoustic transducer of claim 1, wherein the voice coil has outer dimensions that are bounded by outer dimensions of the first and second magnetic pairs.

21. The electro-acoustic transducer of claim 1, wherein the voice coil has a longitudinal dimension that is parallel to the first and second magnetic gaps.

22. The electro-acoustic transducer of claim 1, wherein the voice coil has a longitudinal dimension that is perpendicular to the first and second magnetic gaps.

23. The electro-acoustic transducer of claim 1, wherein the foldable membrane is an accordion structure.

24. The electro-acoustic transducer of claim 1, wherein the second magnet pair and the second magnetic gap define a width of the electro-acoustic transducer, and wherein the length of the third pole piece is the same as the width of the electro-acoustic transducer defined by the second magnet pair and the second magnetic gap.

* * * * *